United States Patent [19]

Komatsu et al.

[11] 4,337,817

[45] Jul. 6, 1982

[54] METHOD OF JOINING A MEMBER TO A DIECAST ARTICLE WRAPPING THEREABOUT IN DIECASTING

[75] Inventors: Mikiya Komatsu; Masashi Arita; Syunsuke Suzuki, all of Yokohama, Japan

[73] Assignee: Nissan Motor Co., Ltd., Yokohama, Japan

[21] Appl. No.: 125,857

[22] Filed: Feb. 29, 1980

[30] Foreign Application Priority Data

Mar. 3, 1979 [JP] Japan ..... 54-24070

[51] Int. Cl.[3] ..... B22D 17/08; B22D 17/20; B22D 19/04

[52] U.S. Cl. ..... 164/120; 164/98; 164/103; 164/105; 164/113

[58] Field of Search ..... 164/120, 319, 320, 321, 164/312, 98, 113, 103, 105

[56] References Cited

U.S. PATENT DOCUMENTS 755,368 3/1904 Hunt ..... 164/320
3,270,383 9/1966 Hall et al. ..... 164/120

FOREIGN PATENT DOCUMENTS 1608775 9/1969 Fed. Rep. of Germany ..... 164/120
1410770 10/1975 United Kingdom .
1417064 12/1975 United Kingdom .

*Primary Examiner*—Gus T. Hampilos
*Attorney, Agent, or Firm*—Schwartz, Jeffery, Schwaab, Mack, Blumenthal & Koch

[57] ABSTRACT

A method for joining a member to a diecast article using an apparatus comprising dies, an injection sleeve communicating with a cavity of the dies and a plunger tip slidably arranged in the injection sleeve for filling the cavity of the dies with the molten metal previously poured in the injection sleeve. According to the invention, the plunger tip is formed with an insert aperture for receiving the member to be joined such that a portion of the member extending beyond an upper surface of the plunger tip is exposed in the molten metal when it is poured in the injection sleeve, thereby sufficiently transmitting the heat of the molten metal to the portion of the member to obtain a metallurgical bond at a boundary between the member and the diecast article.

2 Claims, 8 Drawing Figures

FIG. 1
PRIOR ART
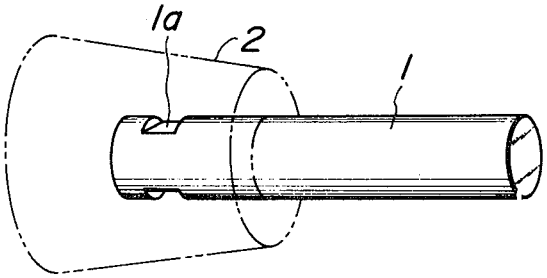
FIG. 2a
FIG. 2b
PRIOR ART
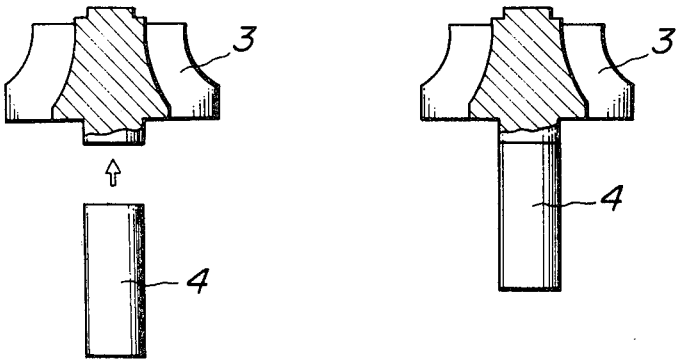

METHOD OF JOINING A MEMBER TO A DIECAST ARTICLE WRAPPING THEREABOUT IN DIECASTING

BACKGROUND OF THE INVENTION

1. Field of the Invention

The present invention relates to a method of joining a member to a diecast article wrapping thereabout in diecasting.

2. Description of the Prior Art

In order to produce a single part made of two different metals, it has been well known to arrange a previously formed metal member in a mold into which a second metal is then poured so as to surround the first metal, thereby rigidly joining the two metals. Frequently, such a method has also been used in diecasting, in making precision castings. In this case, with conventional diecasting machines it is necessary to form an aperture in dies for inserting a member to be joined or to form a boss on the dies for supporting the member to be joined. When joining one end of an elongated member such as a shaft to another surrounding metal, however, dies are needed to form an aperture extending therethrough and to provide any type of positioning fastening means for rigidly supporting the member relative to the dies to prevent the member from being moved by the flowing movement of the molten metal at a high speed, so that the dies become unavoidably very complicated in construction.

In a conventional method of joining a metal to another metal cast thereabout with a diecasting machine, because of the solid metal which has been previously arranged in dies, the molten metal in contact with the solid metal solidifies for a short period of time. More important still, because the molten metal forced into the dies has already lowered its temperature, the joint between the solid metal and the surrounding cast metal is not necessarily satisfactory, and in most cases a metallurgically bonded joint between the two metals cannot be obtained.

In order to solve these problems, it has been suggested that a member 1 to be joined is previously formed with notches 1*a* to obtain a mechanical joint with a surrounding metal 2 as shown in FIG. 1. In this case, however, the member 1 to be joined must be formed with notches at an extra cost.

In the case of heat-resistant impeller with a shaft such as a turbocharger rotor as shown in FIGS. 2*a* and 2*b*, the impeller 3 is made of a heat-resistant alloy such as nickel, cobalt or iron base alloy by a precision casting of the lost wax process and thereafter the shaft made of carbon steel or low alloy steel is joined to the impeller by friction welding, electron-beam welding or the like. In general, however, such joining methods are very difficult because of their severe welding conditions which should be strictly controlled. If the welding conditions are not precisely controlled, the welded portions are prone to develop cracks in the welds resulting in the high percentages of rejected articles. With parts are used at high rotating speeds and high temperatures as is the turbocharger rotor, rigid joints sufficient to resist such severe use conditions are of course needed. In the usual lost wax process, however, it is difficult to join metal members by casting one to surround the other. In addition, with the conventional joining method of casting one to surround the other, a satisfactory joint cannot be obtained as above described.

SUMMARY OF THE INVENTION

It is an object of the invention to provide a method of joining a member to a surrounding diecast article which eliminates all the disadvantages of the prior art and which enable a member to be joined and a molten metal to be into contact with each other before the temperature of the molten metal has lowered to achieve a metallurgical bond at a boundary between the member and the diecast article with ease.

The apparatus used in the method according to the invention for joining a member to a diecast article diecast thereabout comprises dies having a die cavity therein, an injection sleeve capable of communicating with said die cavity and a plunger tip slidably arranged in said injection sleeve for forcibly filling said die cavity with a molten metal previously poured in said injection sleeve, said plunger tip being connected to a driving mechanism and formed with an insert aperture for receiving said member such that a portion thereof to be surrounded by said diecast article is exposed in said molten metal when it is poured in said injection sleeve.

The method according to the invention of joining a member to a diecast article diecast thereabout wherein dies are forcibly filled with a molten metal by means of forcible feeding means comprises the steps of carrying said member along an operation of said forcibly feeding means, forcibly filling said dies with the molten metal and solidifying it around said member.

In order that the invention may be more clearly understood, preferred embodiments will be described, by way of example, with reference to the accompanying drawings.

BRIEF DESCRIPTION OF THE DRAWINGS

FIG. 1 is a perspective view of a conventional method of joining two metals by casting one to surround the other as mentioned above;

FIGS. 2*a* and 2*b* are plan views of an impeller before and after a shaft is joined thereto by a conventional method as mentioned above;

DETAILED DESCRIPTION OF THE PREFERRED EMBODIMENT

Figure 3:
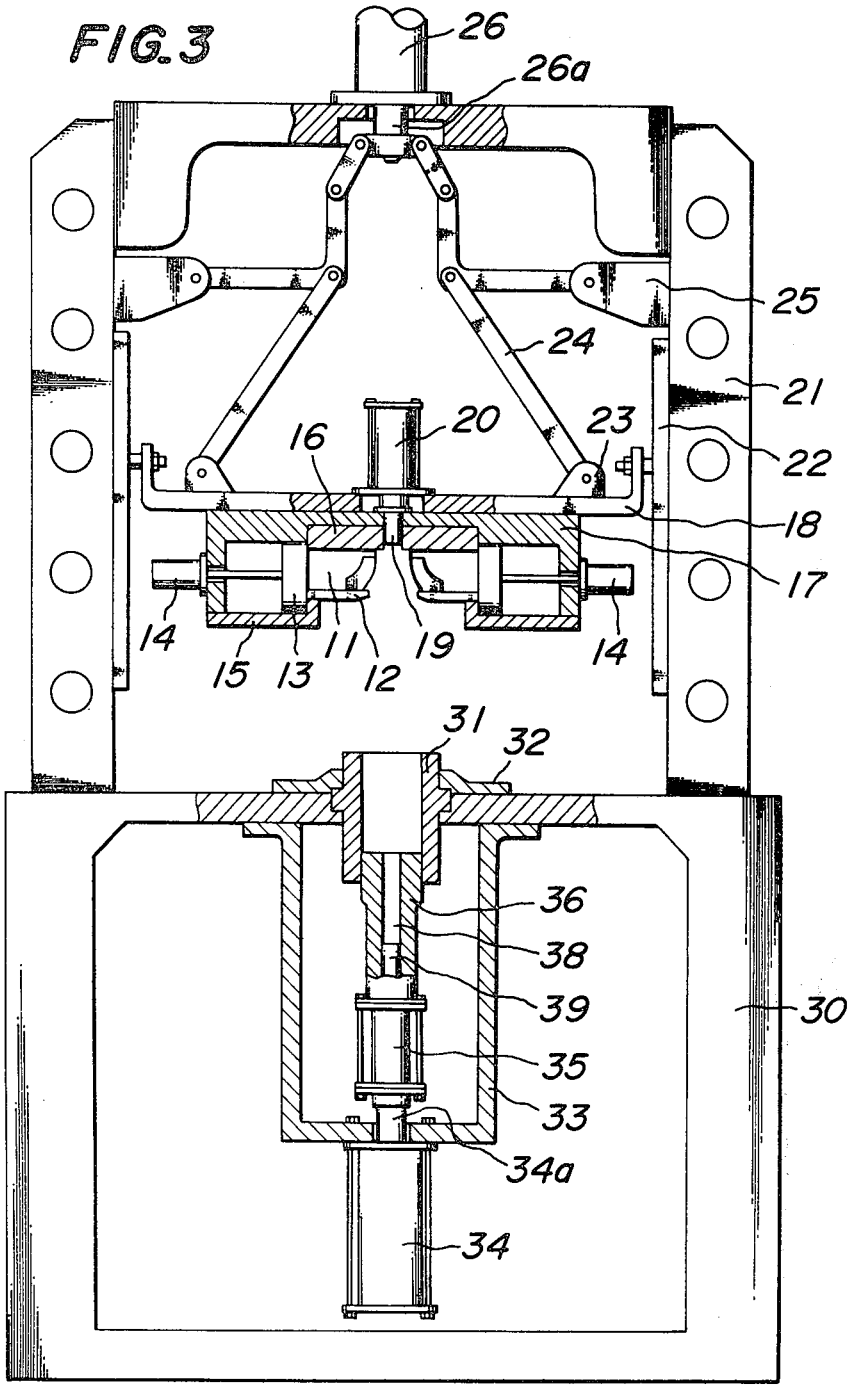
FIG. 3 is a partial section view of a vertical diecasting machine with open dies according to the invention.

FIG. 3 illustrates a vertical diecasting machine, partly in section, of one embodiment of the invention comprising dies 11 in the proximity of its center. The dies 11 are shown for diecasting the impeller 3 as shown in FIGS. 2*a* and 2*b* and consist of divided dies whose number corresponds to the number of the blades. The divided dies are radially advanced or opened and retracted or closed together with runner forming dies 12 arranged therebelow by means of hydraulic cylinders 14 with supports 13 to close and open the dies 11. The supports 13 are slidable on lower covers 15. Above the dies 11 there is provided an upper die 16 supported together with the lower covers 15, hydraulic cylinders 14 and a die frame 17 by a ram 18 to which is fixed a hydraulic cylinder 20 having a push pin 19. The ram 18 is arranged vertically slidable along guide rails 22 secured to columns 21 and adapted to be raised and lowered by action of a piston rod 26*a* of a hydraulic cylinder 26 through a plurality of brackets 23, links 24 and stays 25.

A bed 30 includes an injection sleeve 31 fixed thereto by an injection sleeve holder 32 aligned with the dies 11. An injection device suspension structure 33 is fixed to the bed 30 and has a hydraulic cylinder 34 including a piston rod 34*a* to which is fixed an inner injection hydraulic cylinder 35. To a main body of the inner injection hydraulic cylinder 35 is fixed a plunger tip 36 slidable in the injection sleeve 31. The plunger tip 36 is formed with an insert aperture 38 for inserting a member 37 to be joined shown in FIG. 4. An inner plunger tip 39 connected to a piston rod 35*a* of the inner injection hydraulic cylinder 35 is slidably arranged in the insert aperture 38.

According to the principle of the invention, the plunger tip 36 may be formed with a bottomed insert aperture 38 having a desired depth so that a portion of the member 37 to be surrounded by a diecast article projects a desired height beyond the upper surface of the plunger tip 36, and the piston rod 34*a* of the injection hydraulic cylinder 34 may be directly connected to the plunger tip 36 without providing the inner plunger tip 39 and inner injection hydraulic cylinder 35. With such an arrangement, the objects of the present invention can be sufficiently accomplished as explained later.

Figure 4:
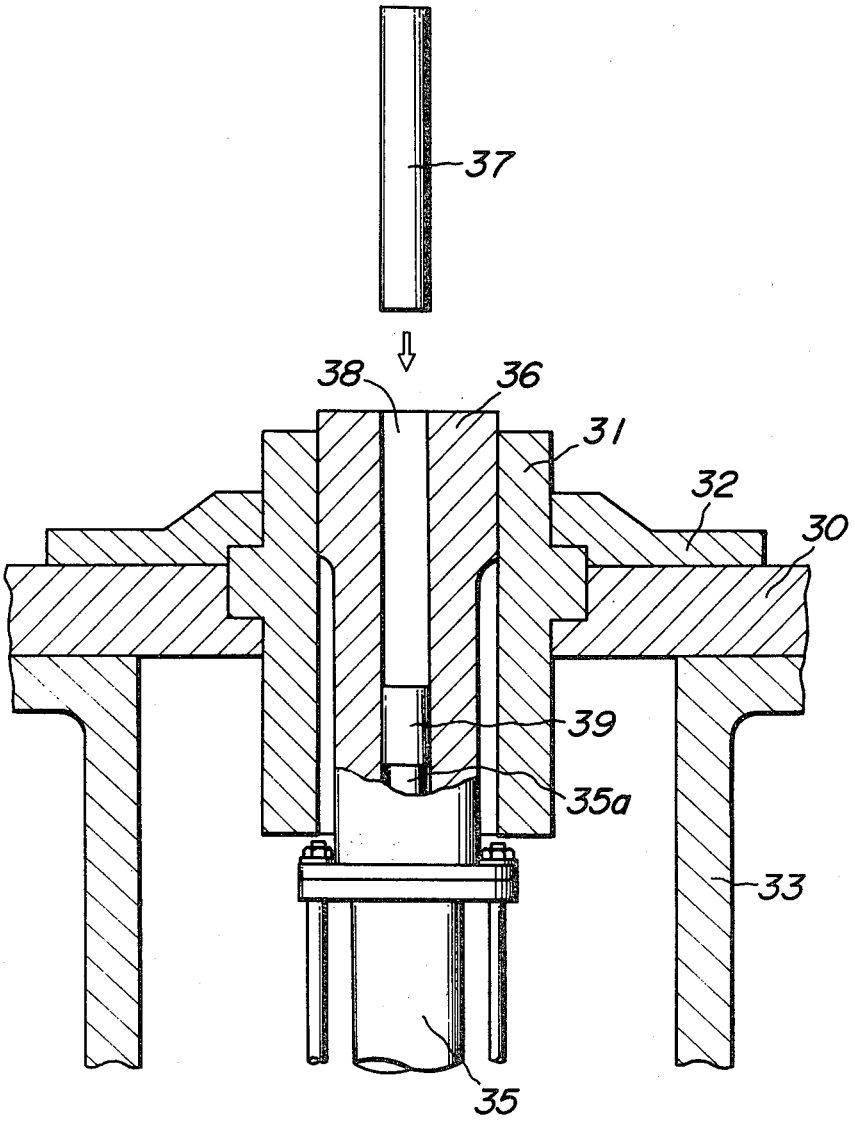
FIG. 4 is a sectional view illustrating a member to be joined inserting into a plunger tip of the diecasting machine according to the invention.
Figure 5:
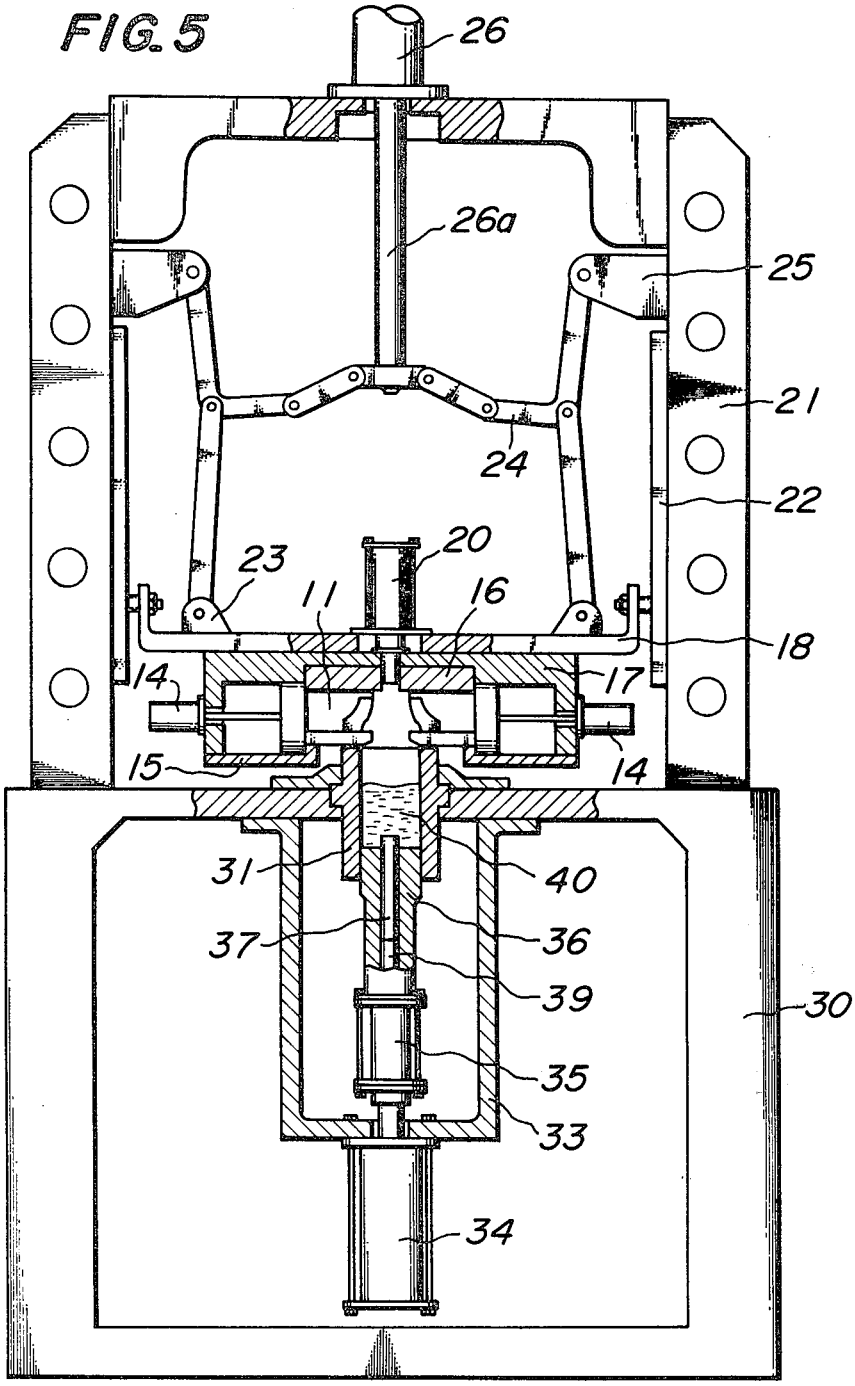
FIG. 5 is a partial section view of the diecast machine with closed dies.
Figure 6:
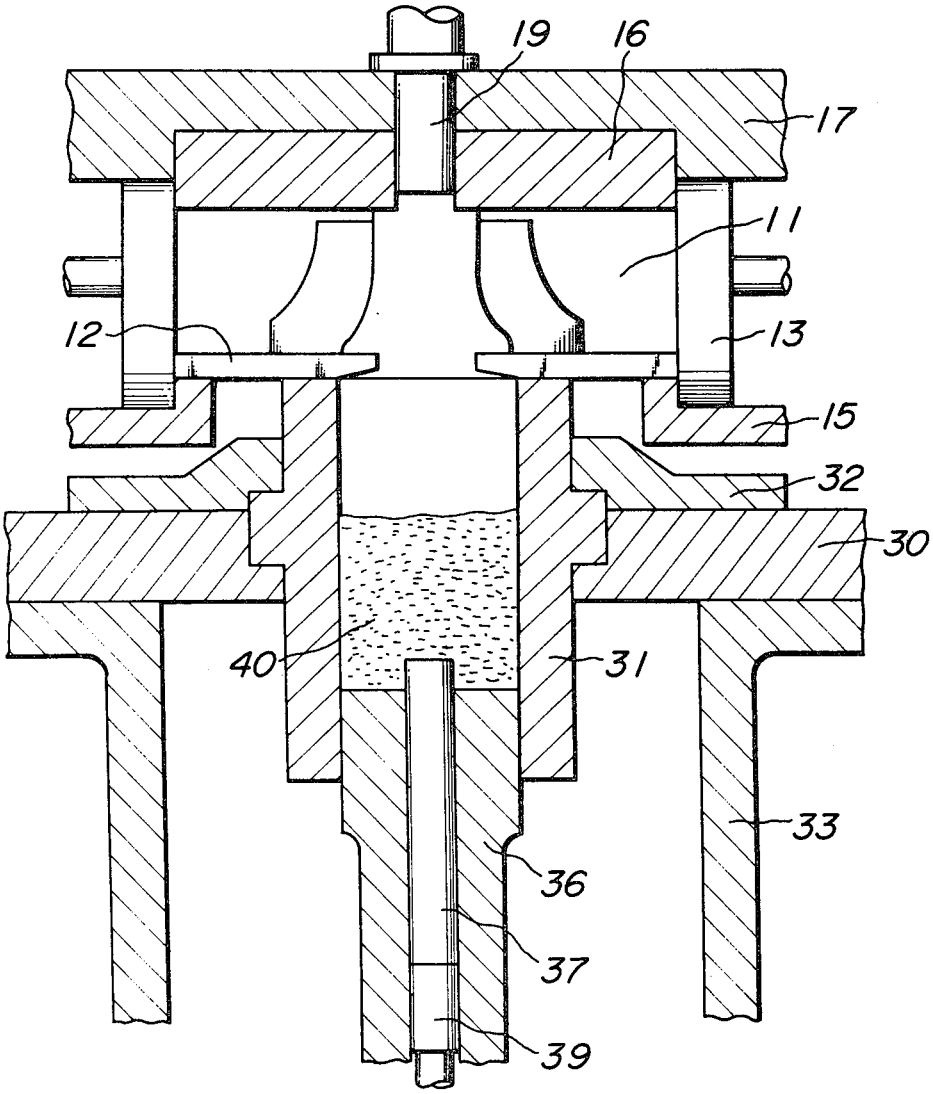
FIG. 6 is an enlarged sectional view of the dies shown in FIG. 5.

In an actual diecasting operation, when the dies 11 are positioned by retracting the piston rod 26*a* of the hydraulic cylinder 26 as shown in FIG. 3, the injection hydraulic cylinder 34 is operated to raise the inner injection hydraulic cylinder 35, inner plunger tip 39 and plunger tip 36 in unison as shown in FIG. 4. Under this condition, the plunger tip 36 is previously set so that its upper end extends somewhat beyond the upper surface of the injection sleeve 31, thereby enabling the member 37 in the form of an elongated shaft to be inserted very easily and rapidly into the insert aperture 38 of the plunger tip 36 as indicated by an arrow in FIG. 4. After the member 37 has been inserted in the insert aperture 38, the upper end of the member 37 extends beyond the upper surface of the plunger tip 36 by the distance to which it is to be surrounded by a diecast article in the diecast dies 11 as explained later (FIGS. 5 and 6).

Figure 7:
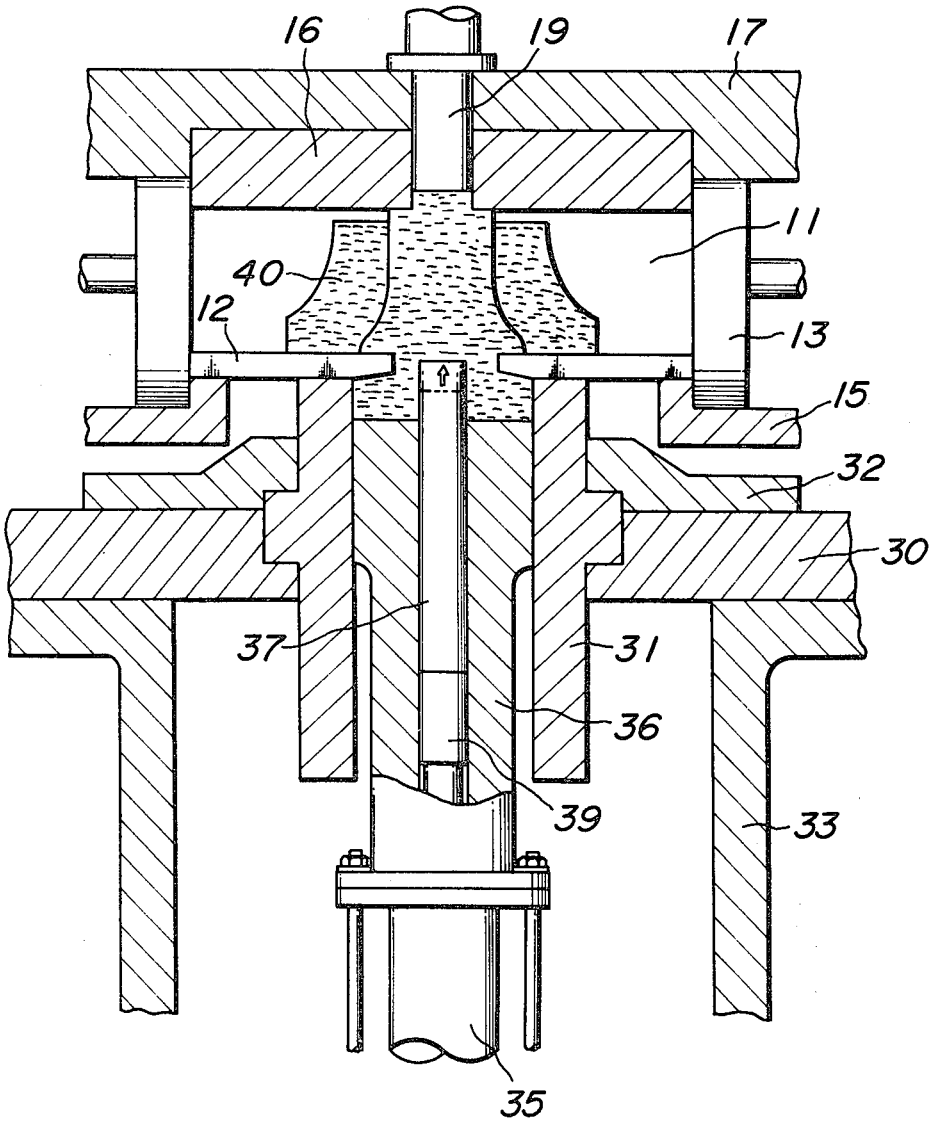
FIG. 7 is an enlarged sectional view of the dies filled with the molten metal.

After the member 37 to be joined has been inserted in the insert aperture 38 of the plunger tip 36 as described, the piston rod 34*a* of the injection hydraulic cylinder 34 is retracted to lower the plunger tip 36 to its injection fully retracted position. Under this condition, a desired amount of molten metal 40 is poured into the injection sleeve 31 (FIGS. 5 and 6). As soon as the pouring of the molten metal is completed, the hydraulic cylinder 26 is actuated to lower the ram 18 with the aid of the links 17 until the runner forming dies 12 below the dies 11 comes in contact with the upper end of the injection sleeve 31. The hydraulic cylinder 26 maintains the dies thus clamped as shown in FIGS. 5 and 6. As soon as the runner forming dies 12 below the dies 11 abut against the upper end of the injection sleeve 31, the injection hydraulic cylinder 34 is actuated to raise the plunger tip 36 together with the member 37. The molten metal 40 is therefore forced between the runner forming dies 12 so that a die cavity formed in the dies 11 is forcedly filled with the molten metal 40. Before the molten metal has solidified, the inner injection hydraulic cylinder 35 is actuated to raise only the member 37 to be joined as shown by an arrow in FIG. 7.

The clamped condition of the dies 11 and injection sleeve 31 is maintained by the hydraulic cylinder 26 for the time required for the solidification of the molten metal 40 forcibly injected into the die cavity formed in the dies 11.

After the time required for the solidification of the molten metal has expired, the piston rod 26*a* of the hydraulic cylinder 26 is retracted to raise the dies 11 together with the ram 18 and the pistons of the hydraulic cylinders 14 are then retracted to open the dies 11 to their most retracted positions. Under the most open or most retracted position of the dies, the hydraulic cylinder 20 is actuated to lower the push pin 19 so as to separate from the dies 11 the diecast impeller surrounding the end of the elongated shaft-like member 37 joined thereto.

As the portion of the elongated shaft-like member 37 to be surrounded by the diecast article is exposed beyond the upper surface of the plunger tip 36 in the manner shown in FIG. 6, that portion would be continuously in contact with the molten metal 40 of high temperature beginning immediately after the pouring of the molten metal 40 into the injection sleeve 31, so that the heat in the molten metal 40 at the high temperature is sufficiently transmitted to that portion of the member 37 to be surrounded by the diecast article. Accordingly, after the molten metal has solidified which was forcibly injected into the die cavity of the dies 11 by raising the molten metal 40 poured in the injection sleeve 31 as shown in FIG. 6 together with the member 37 to be joined thereto with the aid of the actuation of the injection hydraulic cylinder 34, a metallurgically bonded joint at the boundary between the solidified metal and member 37 to be joined thereto is obtained which is a rigid embedded joint by casting. Such a rigid joint can be also obtained by use of a device wherein the lower end of the plunger tip 36 is directly connected to the piston rod 34*a* of the injection hydraulic cylinder 34 without providing the inner injection hydraulic cylinder 35 for raising only the member 37 to be joined.

In a case as shown in the drawings where there is provided the inner injection hydraulic cylinder 35 for slidingly moving the member 37 alone to be joined, the member 37 is further raised after the cavity of the dies has been filled with the molten metal 40, so that the portion of the member 37 to be surrounded by the diecast article, particularly the uppermost end of the member 37 is brought into contact with the molten metal at a high pressure to remarkably reduce the resistance to thermal transmission of the surface of the member in contact with the molten metal thereby further improving the metallurgically bonded joint. In general, a molten metal charged in a cavity of dies tends to cause casting defects such as shrinkage cavities, pinholes or the like when the molten metal is solidifying. With the arrangement shown in the drawings, however, as the member 37 to be joined can be advanced into the molten metal while the molten metal in the cavity of the dies is solidifying, the solidifying molten metal is replenished with the molten metal which has not yet solidified in the injection sleeve 31 to eliminate the inner defects of the diecast article such as shrinkage cavities, pinholes or the like.

Furthermore, as the inner injection hydraulic cylinder 35 makes the inner plunger tip 39 slidable and the stopped position of a piston rod of the inner injection hydraulic cylinder 35 can be suitably changed to adjust the depth of the insert aperture 38, the extending height of the member 37 to be joined beyond the upper surface of the plunger tip 36 or the amount of the member 37 to be surrounded by the diecast article is advantageously adjustable at will.

Moreover, as the inner injection hydraulic cylinder 35 enables the waiting position of the inner plunger tip 39 to be varied in the same manner, members 37 of different lengths can be joined to respective diecast articles in a simple manner irrespective of their lengths without any change of the parts of the machine.

In this manner, the invention can also be effectively applied to manufacturing of heat-resistant impellers with shafts such as turbocharger rotors. Namely, a member 37 or a shaft to be joined made of, for example, relatively inexpensive carbon steel or low alloy steel is first inserted in the insert aperture 38 of the plunger tip 36 and molten metal 40 of heat-resistant alloy of nickel, cobalt or iron base alloy is poured into the injection sleeve 31. At this stage the portion of the shaft extending beyond the plunger tip 36 is continuously exposed to the molten metal 40 at the high temperature, so that the heat in the molten metal 40 is sufficiently transmitted to the portion of the shaft to be surrounded by the diecast article to facilitate the metallurgical joint between the different kind metals. Thereafter, the plunger tip 36 is raised together with the shaft to cause the dies 11 to be completely filled with the molten metal 40 so that the molten metal 40 and shaft 37 are in complete contact with each other to form the metallurgical joint at their boundary while the molten metal is solidifying. According to the invention, as a very complete joint between member and casting is obtained in this manner, the joint can be sufficiently applicable to rotary bodies rotating at high speeds such as turbocharger rotors. In this case, no casting defects as shrinkage cavities and pinholes of course occur in bosses at the center of the turbocharger rotors.

In the above embodiment, although the invention has been explained referring to the vertical diecasting machine, the invention is not limited to such a vertical machine but is applicable to general horizontal diecasting machine. In this case, it is of course necessary to carry out the invention in consideration of the particular construction of the horizontal machine different from the vertical one.

As can be seen from the above description, according to the invention an elongated shaft-like member can be joined to a diecast article by surrounding with a casting while the diecast article is being diecast. In addition, according to the invention a portion of the member to be joined is exposed in the molten metal since the pouring of the molten metal, and dies are forcibly filled with the molten metal while the member is maintained under this exposed condition, so that the very good joints by surrounding casting can be achieved.

It is further understood by those skilled in the art that the foregoing description exemplifies preferred embodiments of the disclosed apparatus and method and that various changes and modifications may be made in the invention without departing from the spirit and scope thereof.

We claim:

1. A method of joining a member to a diecast article, using an apparatus comprising a die defining a die cavity therein, an injection sleeve associated with said die and communicating with said die cavity, a forcible feed means slidably arranged in said injection sleeve for forcibly filling said die cavity with a molten metal, means associated with said forcible feed means for driving said forcible feed means, said forcible feed means including a tip portion defining an aperture adapted to receive a member, means associated with said forcible feed means for displacing a portion of a member beyond an outermost surface of said tip portion defining said aperture to expose sides of a member to a cavity defined by walls of said injection sleeve, said method comprising the steps of:

(a) inserting a member into said aperture, said member cooperating with said displacing means such that a portion of said member extends beyond an outermost surface of said tip portion of said forcible feed means to expose an end surface and side surfaces of said member to the cavity defined in said injection sleeve;

(b) filling said sleeve with molten metal to surround said portion of said member with said molten metal to preheat said portion to a degree such that a metallurgical bond will be obtained upon casting said metal about said portion;

(c) injecting said metal into said die cavity by translation of said forcible feed means along said injection sleeve while maintaining said portion of said member exposed to said molten metal; and (e) solidifying said metal about said member.

2. A method as set forth in claim 1 and further including the steps of additionally pressurizing the metal after having been injected into said die cavity by moving said member further into said die cavity.

* * * * *